United States Patent [19]

De Maria

[11] 4,290,234

[45] Sep. 22, 1981

[54] DEMOUNTABLE WINDOW CONSTRUCTION

[76] Inventor: Carmine De Maria, 39 E. Madison Ave., Collingswood, N.J. 08108

[21] Appl. No.: 76,618

[22] Filed: Sep. 18, 1979

[51] Int. Cl.[3] ..... E05D 15/16

[52] U.S. Cl. ..... 49/415; 49/421; 49/454; 49/455

[58] Field of Search ..... 49/454, 453, 456, 457, 49/455, 463, 466, 465, 446, 421, 415

[56] References Cited

U.S. PATENT DOCUMENTS

| | | | |
|---|---|---|---|
| 554,088 | 2/1896 | Payment et al. | 49/455 |
| 602,712 | 4/1898 | Appell | 49/455 |
| 765,025 | 7/1904 | Machen | 49/415 |
| 1,461,023 | 7/1923 | Becker | 49/454 X |
| 1,560,930 | 11/1925 | Wright | 49/415 |
| 2,728,117 | 12/1955 | Zappone et al. | 49/453 X |
| 2,740,998 | 4/1956 | Zitomer | 49/453 |

*Primary Examiner*—Philip C. Kannan
*Attorney, Agent, or Firm*—Harvey B. Jacobson

[57] ABSTRACT

A stationary window frame slidably mounts a pair of sash assemblies that are retained in the frame by fixed retainer bars limited to the lower half of the frame and by a pivotally suspended retainer for the upper half. The sash assemblies may be removed from the frame in their raised positions after displacement of the pivoted retainer to a release position.

3 Claims, 6 Drawing Figures

Fig. 3
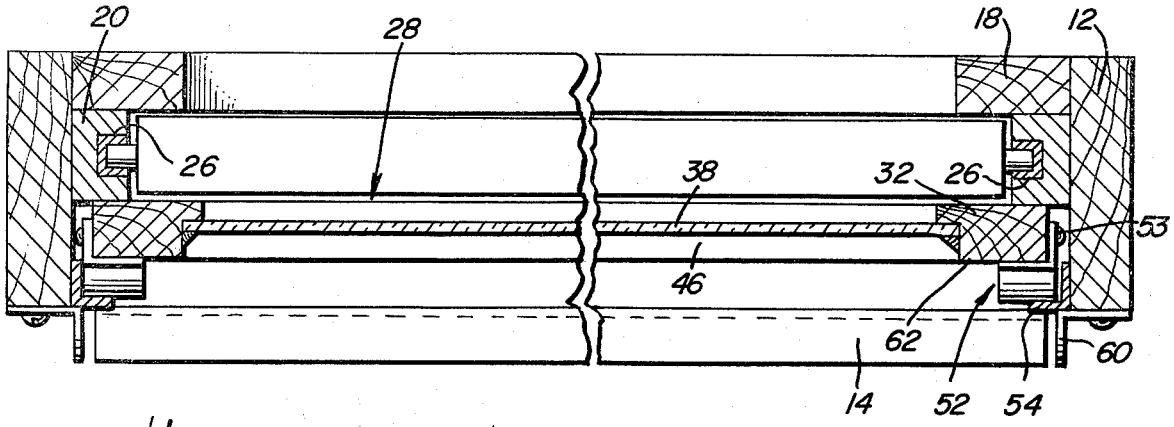
Fig. 4
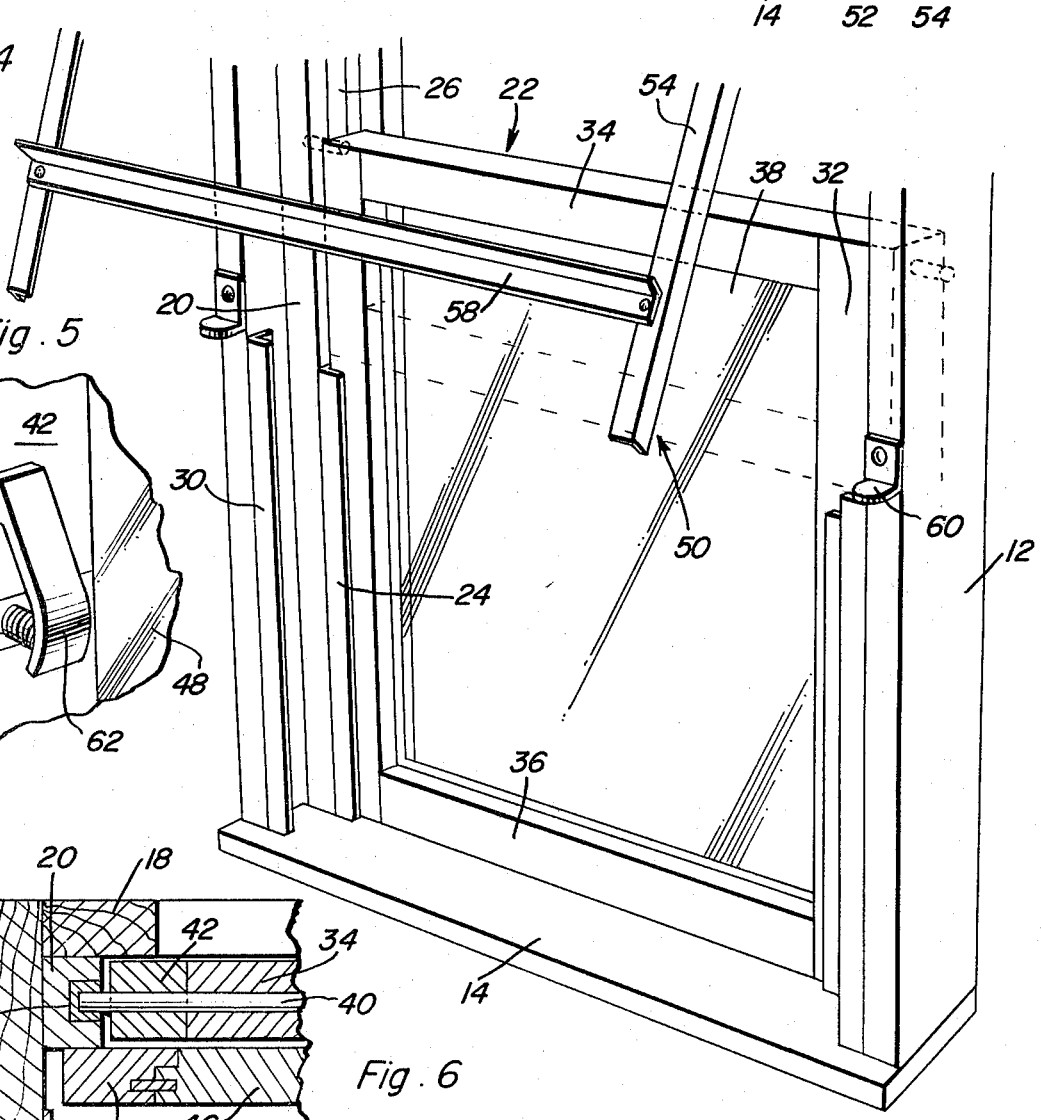
Fig. 5
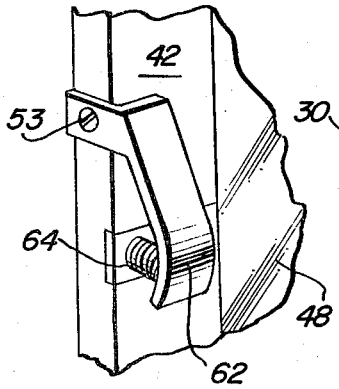
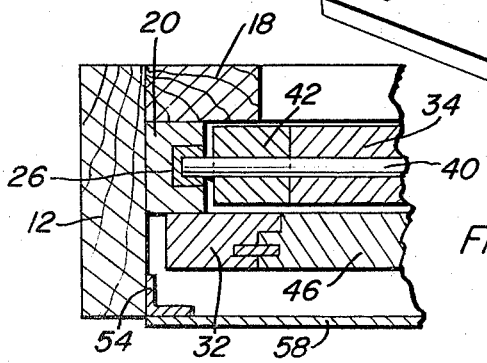
Fig. 6

DEMOUNTABLE WINDOW CONSTRUCTION

BACKGROUND OF THE INVENTION

This invention relates to improvements in window assemblies.

Window assembly installations of the slidable sash type do not generally accommodate easy removal of the sash assemblies. Thorough cleaning of the window assembly is therefore more difficult. It is therefore an important object of the present invention to provide a window construction by means of which the sash assemblies may be readily removed without use of tools. A further object is to provide a window construction in which the sash assemblies are frictionally held in vertically adjusted position by means that do not conflict with the easy demountability of the sash assemblies.

SUMMARY OF THE INVENTION

In accordance with the present invention, a rectangular window frame slidably supports a pair of sash assemblies and fixedly mounts retainer bars to prevent removal of the sash assemblies from the frame in the lowered positions. In the upper positions, removal of the sash assemblies is prevented by a pivotally suspended retainer while locked in position by a pair of pivoted locking tabs. Pivotal displacement of the retainer to a release position enables demounting of the sash assemblies from their raised positions.

The sash assemblies are frictionally held in vertically adjusted positions by the lateral pressure of the pivoted retainer held locked in retaining position by means of frictional holding devices mounted on the front sash assembly.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

FIG. 3 is an enlarged transverse section view taken substantially through a plane indicated by section line 3—3 in FIG. 1.

FIG. 4 is a partial perspective view of the lower portion of the window assembly.

FIG. 5 is a partial perspective view of one of the sash assemblies showing a frictional holding device mounted thereon.

FIG. 6 is an enlarged partial section view taken substantially through a plane indicated by section line 6—6 in FIG. 2.

DETAILED DESCRIPTION OF PREFERRED EMBODIMENT

Figure 1:
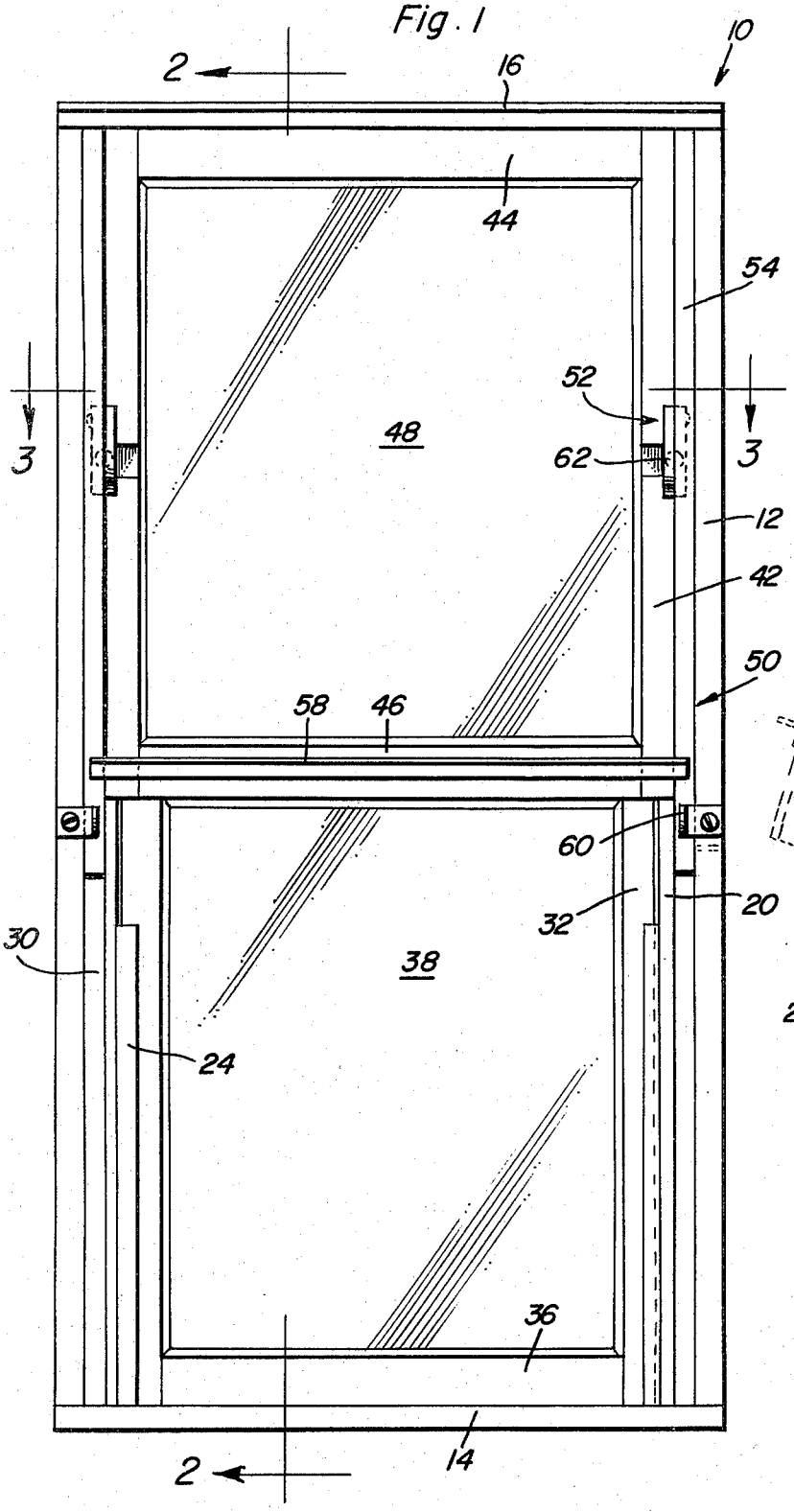
FIG. 1 is a front elevation view of a window assembly constructed in accordance with the present invention.

Referring now to the drawings in detail, FIG. 1 illustrates a window installation generally referred to by reference numeral 10, constructed in accordance with the present invention. The window opening is framed by a pair of vertical side frame members 12 interconnected in parallel spaced relation by a horizontal sill member 14 at the bottom and a top molding member 16 at the upper ends. Connected at right angles to the side frame members 12 are rear vertical retaining members 18 as more clearly seen in FIG. 3. Connected to the side frame members intermediate the rear and front edges thereof are vertical guide members 20. The foregoing frame members are preferably made of wood.

A rear window sash assembly 22 is slidably mounted between the vertical guide members 20 and is retained in a lowered position as shown by angle iron retainer bars 24 secured to the guide members 20. The sash assembly 22 is guided for vertical movement along the upper half of the window opening by guide tracks 26 embedded in the members 20. A front sash assembly 28 is slidably mounted forwardly of the guide members 20 and is retained between the side frame members 12 in its lowered position by angle iron retainer bars 30 secured to the side frame members. The front sash assembly 28 is somewhat wider than the rear sash assembly 22 since it extends horizontally between the side frame members 12 beyond the guide members 20.

The rear sash assembly 22 includes a pair of vertical frame members 32 interconnected by upper and lower frame members 34 and 36 to support a glass pane 38 in a manner well-known in the art. A rod 40 extends laterally from the upper ends of the vertical frame members 32 for reception within the guide tracks 26 as more clearly seen in FIG. 6. The front sash assembly 28 is formed by vertical frame members 42 interconnected by horizontal frame members 44 and 46 to support a glass pane 48.

The front sash assembly 28 is retained in the window assembly by a pivotally suspended retainer assembly 50 which also cooperates with a pair of friction holding devices 52 mounted on the frame members 42 of the sash assembly 28 to hold the sash assembly in vertically adjusted positions thereof.

The pivoted retainer assembly 50 includes a pair of angle iron bars 54 pivotally connected at their upper ends to the side frame members 12 by pivot bolts 56. A cross bar 50 interconnects the vertical bars 54 adjacent their lower ends. The retainer assembly 50 is locked in its sash retaining position forming upward continuations of the bars 30 by means of a pair of pivoted locking tabs 60 mounted on the front edges of the side frame members 12 for engagement with the lower end portions of the bars 54 as shown in FIG. 1. The tabs 60 are pivotally displaceable to release positions as shown in FIG. 4 to enable pivotal displacement of the retainer assembly to a release position out of contact with the friction holding devices 52.

Each of the friction holding devices 52 includes a curved plate element 62 pivotally suspended on the frame member 42 by pivot 53 as shown in FIGS. 3 and 5, biased outwardly by spring 64 to frictionally engage the corresponding bar 54 of the retainer assembly when locked by tabs 60 in its retaining position. Accordingly, the sash assemblies will be frictionally held in any vertical position to which they are slidably displaced.

Figure 2:
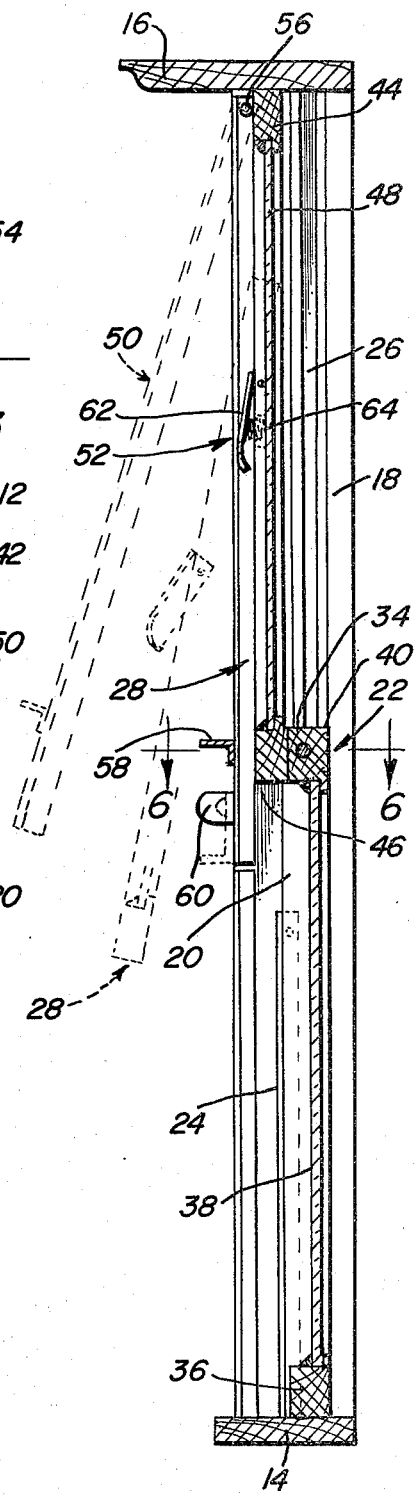
FIG. 2 is a side section view taken substantially through a plane indicated by section line 2—2 in FIG. 1.

The sash assemblies may be readily removed from the window frame by raising the sash assembly 28 to its upper position as shown in FIGS. 1 and 2 and then releasing the lock tabs 60. The retainer assembly 50 may then be displaced to a position as shown by dotted line in FIG. 2. The sash assembly 28 may then be swung out and down as shown by dotted line in FIG. 2 to remove it for cleaning or repair purposes. The rear sash assembly 22 may then be raised to an upper position above the retainer bars 24 and also removed by being swung outwardly. The sash assemblies are installed in the reverse order and held in place by the retainer assembly 50 with the tabs 60 in locking positions.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A window construction including a frame having opposite side parallel vertical side frame members interconnected at their upper and lower ends by top and bottom transverse horizontal members extending and secured between the upper and lower ends of said side frame members, said frame defining an opening therethrough, bound by said members, and including front and rear portions, said rear portion of said frame including inwardly projecting and forwardly facing opposite side vertical retaining members supported from and extending at least substantially fully along said side frame members, a lower rear sash assembly disposed in said frame immediately forwardly of and guidingly engaged with the forwardly facing surfaces of said retaining members for guided vertical shifting of said lower sash assembly in said frame, at least the upper portions of said side frame members including vertically extending inwardly opening grooves formed therein and spaced forwardly of said forwardly facing surfaces, the upper opposite side portions of said lower sash assembly including oppositely outwardly projecting members slidably and rotatably received in said grooves, the lower portions of said side frame members including first inwardly projecting and vertically extending retaining flanges whose upper ends are spaced below the upper limit of travel of said lower sash assembly in said frame and behind which said lower sash assembly is snugly slidably received when said lower sash assembly is lowered in said frame, said side frame members defining forwardly facing vertical guide surfaces spaced slightly outwardly of the remote side surfaces of said lower sash assembly in a plane spaced slightly forward of the forward face of said lower sash assembly and extending substantially fully along said side frame members, a front upper sash assembly disposed in said frame immediately forwardly of and guidingly engaged with said guide surfaces for guided vertical shifting of said upper sash assembly in said frame forward of said rear sash assembly and in passing relation therewith, said opposite side frame members including second lower inwardly projecting and vertically extending retaining flanges whose upper ends are spaced above the upper ends of said first flanges and below the upper limit of travel of said lower sash assembly in said frame and behind which said upper sash assembly is snugly slidably received when said upper sash assembly is lowered in said frame, a retainer assembly including vertical opposite side bars defining third inwardly projecting vertical flanges, the upper ends of said bars being pivotally supported from the upper ends of said side frame members with said bars closely overlying the forwardly facing opposite side portions of said upper sash for guidingly mounting the latter within said frame against removal therefrom, said retainer assembly being swingably supported from said frame for outward and upward swinging of the lower ends of said bars toward open positions, latch means carried by said frame for releasably latching said retainer assembly in a closed position with the lower ends of said third flanges being coextensive with the upper ends of said second flanges when said retainer is in said closed position, and yieldable friction means mounted on said upper sash assembly for engagement with said bars, when said retainer assembly is in the closed position, to bias said upper sash assembly rearwardly against said guide surfaces and to frictionally hold the sash assemblies in vertically adjusted positions thereof.

2. The combination of claim 1 including a cross bar extending and connected between the lower ends of said side bars and closely overlying the forward side of the lower margin of said upper sash assembly when the latter is in its uppermost position and said retainer assembly is in the closed position thereof.

3. The combination of claim 1 wherein said yieldable friction means comprises curved spring biased plates pivotally supported from the forward opposite side portions of said upper sash assembly slidably and frictionally engaged with the rear sides of said third vertical flanges when said retainer assembly is in the closed position thereof.

* * * * *